US011286843B2

(12) United States Patent
Steinmetz et al.

(10) Patent No.: US 11,286,843 B2
(45) Date of Patent: Mar. 29, 2022

(54) SYSTEM FOR FAN CONTROL

(71) Applicant: ENGINEERED MACHINED PRODUCTS, INC., Escanaba, MI (US)

(72) Inventors: Timothy M. Steinmetz, Gladstone, MI (US); Todd M. Steinmetz, Escanaba, MI (US)

(73) Assignee: Engineered Machined Products, Inc., Escanaba, MI (US)

( * ) Notice: Subject to any disclaimer, the term of this patent is extended or adjusted under 35 U.S.C. 154(b) by 0 days.

(21) Appl. No.: 16/985,433

(22) Filed: Aug. 5, 2020

(65) Prior Publication Data

US 2021/0054776 A1 Feb. 25, 2021

Related U.S. Application Data

(60) Provisional application No. 62/889,287, filed on Aug. 20, 2019.

(51) Int. Cl.

| | |
|---|---|
| ***F01P 11/10*** | (2006.01) |
| ***F01P 7/00*** | (2006.01) |
| ***B60K 11/06*** | (2006.01) |
| ***F01P 11/14*** | (2006.01) |
| ***F01P 7/04*** | (2006.01) |
| ***F01P 7/10*** | (2006.01) |
| ***F01P 7/16*** | (2006.01) |

(52) U.S. Cl.

CPC ..... *F01P 11/14* (2013.01); *F01P 7/04* (2013.01); *F01P 7/10* (2013.01); *F01P 7/167* (2013.01); *F01P 2007/168* (2013.01); *F01P 2023/08* (2013.01); *F01P 2025/62* (2013.01); *F01P 2025/66* (2013.01); *F01P 2037/00* (2013.01); *F01P 2060/06* (2013.01); *F01P 2060/08* (2013.01); *F01P 2060/12* (2013.01)

(58) Field of Classification Search

CPC . B60K 11/06; F01P 11/10; F01P 7/048; F01P 1/00; F01P 2031/30; F01P 2023/00; F01P 2023/08; F01P 7/167

See application file for complete search history.

(56) References Cited

U.S. PATENT DOCUMENTS

| | | | | |
|---|---|---|---|---|
| 6,750,623 | B1 | 6/2004 | McCauley et al. | |
| 7,424,868 | B2 | 9/2008 | Reckels et al. | |
| 7,484,378 | B2 | 2/2009 | Mien et al. | |
| 7,533,635 | B2 | 5/2009 | Bradley et al. | |
| 2003/0183433 | A1 * | 10/2003 | MacKelvie ..... | G01P 5/04 180/68.1 |
| 2012/0057989 | A1 | 3/2012 | Cho | |

(Continued)

FOREIGN PATENT DOCUMENTS

WO 2015088423 A1 6/2015

*Primary Examiner* — Long T Tran

(74) *Attorney, Agent, or Firm* — Brooks Kushman P.C.

(57) ABSTRACT

A system for controlling a fan in a vehicle having a heat exchanger may include defining first and second geographic areas and determining a geographic location of the vehicle. A processor may be programmed to send a signal to operate the fan in a first rotational direction to move air through the heat exchanger in a first direction, and to send a signal to the fan to operate it in a second rotational direction opposite the first rotational direction to move air through the heat exchanger in a second direction opposite the first direction when a plurality of conditions are met.

20 Claims, 5 Drawing Sheets

(56) References Cited

U.S. PATENT DOCUMENTS

| | | | | |
|---|---|---|---|---|
| 2016/0061093 | A1 | 3/2016 | Johansson et al. | |
| 2017/0002719 | A1* | 1/2017 | Dudar | F01P 1/06 |
| 2018/0312039 | A1* | 11/2018 | Sakane | F01P 11/10 |
| 2019/0211739 | A1* | 7/2019 | Maeda | F01P 7/04 |
| 2019/0248206 | A1* | 8/2019 | Sato | B60H 1/22 |
| 2019/0272687 | A1* | 9/2019 | Dudar | F01P 5/043 |
| 2020/0149461 | A1* | 5/2020 | Shidara | F01P 5/06 |

* cited by examiner

SYSTEM FOR FAN CONTROL

CROSS-REFERENCE TO RELATED APPLICATIONS

This application claims the benefit of U.S. provisional application Ser. No. 62/889,287 filed Aug. 20, 2019, the disclosure of which is hereby incorporated in its entirety by reference herein.

TECHNICAL FIELD

The present disclosure relates to a system for controlling a fan in a vehicle.

BACKGROUND

Vehicle cooling systems may be relatively simple—e.g., a fan connected to an engine to move air through a radiator—or they can be very complex having electronically controlled fans, pumps, valves, etc., and may include multiple heat-producing devices and heat exchangers. In order to function properly, the heat exchangers must be able to adequately cool the heat-producing devices, and in the case of a radiator-style heat exchanger, a fan must be able to move a sufficient amount of air over the fins and tubes. When a heat exchanger becomes plugged so that airflow is significantly restricted, it may adversely impact the ability of the cooling system to function. This may be the case, for example, in commercial construction vehicles, trash haulers, and the like, which are often exposed to dirt and debris in the ambient environment. Although it may be possible to manually clean dirt and debris from a heat exchanger—through fan control or otherwise—it would be desirable to have a system and method for automatically cleaning the heat exchanger under certain predetermined conditions.

SUMMARY

Embodiments described herein may include a control system for a vehicle having a heat exchanger and a fan operable to move air through the heat exchanger. The control system may include a positioning system operable to determine a geographic location of the vehicle, and a processor in communication with the positioning system. At least one of the processor or the positioning system may be programmed with a defined first geographic area and with a defined second geographic area surrounding the first geographic area. The processor may be configured to send a signal to the fan to operate the fan in a first rotational direction to move air through the heat exchanger in a first direction, and to send a signal to the fan to operate the fan in a second rotational direction opposite the first rotational direction to move air through the heat exchanger in a second direction opposite the first direction when a plurality of conditions are met. The conditions may include the vehicle being within the first geographic area and the vehicle having been outside of the second geographic area since a last time the processor sent a signal to the fan to operate the fan in the second rotational direction.

Embodiments described herein may include a control system for a vehicle having a heat exchanger and a fan operable to move air through the heat exchanger. The control system may include a positioning system operable to determine a geographic location of the vehicle, and a processor in communication with the positioning system. At least one of the processor or the positioning system may be programmed with a first geographic area and with a second geographic area surrounding the first geographic area. The processor may be configured to perform the following: send a signal to the fan to operate the fan in a first rotational direction to move air through the heat exchanger in a first direction based on a first vehicle operating state, and send a signal to the fan to operate the fan in a second rotational direction opposite the first rotational direction to move air through the heat exchanger in a second direction opposite the first direction based on a second vehicle operating state. The second vehicle operating state may include the vehicle being within the first geographic area and the vehicle having been outside of the second geographic area since a last time the processor sent a signal to the fan to operate the fan in the second rotational direction.

Embodiments described herein may include a method for controlling a fan in a vehicle having a heat exchanger. The method may include defining a first geographic area, defining a second geographic area surrounding the first geographic area, and determining a geographic location of the vehicle using an electronic positioning system. The method may further include using a processor in communication with the electronic positioning system to send a signal to operate the fan in a first rotational direction to move air through the heat exchanger in a first direction. The method may also include using a processor to send a signal to the fan to operate the fan in a second rotational direction opposite the first rotational direction to move air through the heat exchanger in a second direction opposite the first direction when a plurality of conditions are met. The conditions may include the vehicle being within the first geographic area and the vehicle having been outside of the second geographic area since a last time the processor sent a signal to the fan to operate the fan in the second rotational direction.

Embodiments described herein may include a control system for a vehicle having a heat exchanger and a fan operable to move air through the heat exchanger. The control system may include a positioning system operable to determine a geographic location of the vehicle, and a processor in communication with the positioning system. At least one of the processor or the positioning system may be programmed with a first geographic area and a second geographic area. The processor may be configured to perform the following: send a signal to the fan to operate the fan in a first rotational direction to move air through the heat exchanger in a first direction based on a first vehicle operating state, and send a signal to the fan to operate the fan in a second rotational direction opposite the first rotational direction to move air through the heat exchanger in a second direction opposite the first direction based on a second vehicle operating state. The second vehicle operating state may include the vehicle being within the first geographic area and the vehicle having been inside the second geographic area prior to or since a last time the processor sent a signal to the fan to operate the fan in the second rotational direction.

Embodiments described herein may include a control system for a vehicle having a heat exchanger and a fan operable to move air through the heat exchanger. The control system may include a positioning system operable to determine a geographic location of the vehicle, and a processor in communication with the positioning system. At least one of the processor or the positioning system may be programmed with a defined first geographic area and with at least one other defined geographic area. The processor may be configured to send a signal to the fan to operate the fan in a first rotational direction to move air through the heat exchanger in a first direction, and to send a signal to the fan to operate the fan in a second rotational direction opposite the first rotational direction to move air through the heat exchanger in a second direction opposite the first direction when a plurality of conditions are met. The conditions may include the vehicle having entered at least one of the at least one other defined geographic area and thereafter having entered the first geographic area.

Embodiments described herein may include a control system for a vehicle having a heat exchanger and a fan operable to move air through the heat exchanger. The control system may include a positioning system operable to determine a geographic location of the vehicle, and a processor in communication with the positioning system. At least one of the processor or the positioning system may be programmed with a first geographic area and a second geographic area. The processor may be configured to: send a signal to the fan to operate the fan in a first rotational direction to move air through the heat exchanger in a first direction based on a first vehicle operating state, and send a signal to the fan to operate the fan in a second rotational direction opposite the first rotational direction to move air through the heat exchanger in a second direction opposite the first direction based on a second vehicle operating state. The second vehicle operating state may include the vehicle having entered the second geographic area and thereafter having entered the first geographic area.

Embodiments described herein may include a control system for a vehicle having a heat exchanger and a fan operable to move air through the heat exchanger. The control system may include a positioning system operable to determine a geographic location of the vehicle, and a processor in communication with the positioning system. At least one of the processor or the positioning system may be programmed with a defined first geographic area and a defined second geographic area. The processor may be configured to facilitate operation of the fan in a first rotational direction to move air through the heat exchanger in a first direction, and to facilitate operation of the fan in a second rotational direction opposite the first rotational direction to move air through the heat exchanger in a second direction opposite the first direction when predetermined conditions are met. The predetermined conditions may include the vehicle having entered the second geographic area and thereafter having entered the first geographic area.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
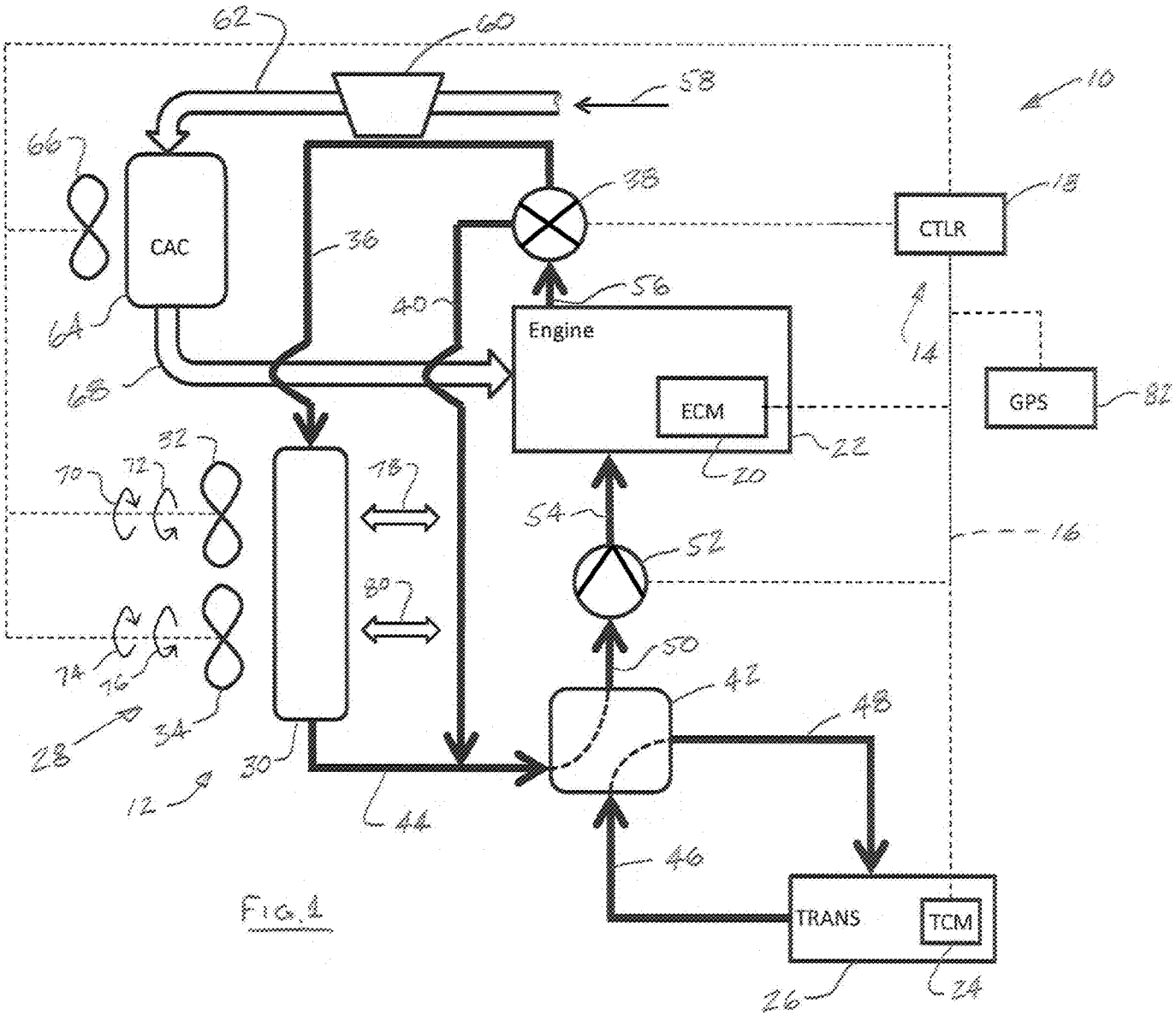
FIG. 1 shows a schematic diagram of a control system in accordance with embodiments described herein.

FIG. 1 shows a control system 10 for a vehicle in accordance with embodiments described herein. The vehicle includes a cooling system 12, elements of which are described in more detail below. The system 10 includes a control system 14, which may include a number of different controls and processors, some or all of which may be linked through a communications link 16. The control system 14 includes a cooling system controller 18, which may have one or more processors configured to receive inputs, perform calculations, and provide outputs. The controller 18 may have an integrated memory storage, or it may have access to one or more information-storage devices. In addition to the cooling system controller 18, the control system 14 includes an engine control module 20 (ECM), which is configured to control an engine 22 and communicate with other controllers on the communications link 16. The control system 14 also includes a transmission control module 24 (TCM), which is configured to control a transmission 26 and communicate with other controllers on the communications link 16. The engine 22 and the transmission 26 may both be considered heat-producing systems of the vehicle, which in at least some embodiments may also or alternatively include other heat-producing systems, such as a battery pack, electric motors, air conditioning system, power electronics, or hydraulic systems, to name just a few.

The cooling system 12 includes a heat-exchanger-and-fan arrangement 28, which has a heat-exchanger unit 30 and fans 32, 34. In the embodiment shown in FIG. 1, the heat-exchanger unit 30 is configured as a radiator to cool engine coolant, which is illustrated by the coolant line 36. A bypass valve 38 is electronically controlled by the controller 18 and allows the engine coolant to bypass the radiator 30 through a bypass line 40. In other embodiments the bypass valve may not be controlled by controller 18 but may be self-regulating such as in the case of a wax-based thermostat. The cooling system 12 also includes an auxiliary heat exchanger 42, which receives coolant through a coolant line 44 and transmission oil through a transmission oil line 46, and exchanges heat between the two mediums. The transmission oil is output from the heat exchanger 42 through another transmission oil line 48 where it returns to the transmission 26. The engine coolant is output from the heat exchanger 42 through another coolant line 50, which provides an intake for a pump 52. As shown in FIG. 1, the pump 52 is also connected to the communications link 16, so that it can be controlled and communicate with the control system 14. In other embodiments, a pump may not be electronically controlled, but may be mechanically attached to the engine—for example, by gears or a belt-and-pully system—and run at a speed that is proportional to engine speed. The coolant is output from the pump 52 through a coolant line 54 and into the engine 22—i.e., the coolant is pumped through a water jacket on the engine 22. The coolant is output from the engine 22 through a coolant line 56, which provides an intake for the bypass valve 38.

FIG. 1 also shows fresh air 58 entering a compressor 60, which may be a part of a turbo charger for the vehicle. The compressor 60 may be connected to a turbine, which may, for example, be driven by exhaust gas leaving the engine 22. On the output side of the compressor 60, an air line 62 carries pressurized, clean air to the charge-air cooler 64. A fan 66 provides airflow over the charge air cooler 64, and the cooled air exits through an intake line 68, which provides intake air to an intake manifold, where it may be mixed with recirculated engine exhaust gas.

As shown in FIG. 1, the fans 32, 34 associated with the radiator 30 may be operated in either of two rotational directions as indicated by the directional arrows 70, 72 and 74, 76, respectively. The controller 18 may operate the fans 32, 34 in a first rotational direction to move air through the radiator 30 in a first direction—i.e., pulling air through the radiator 30—as part of a thermal management strategy. The controller 18 may also operate the fans 32, 34 in a second rotational direction opposite the first rotational direction to move air through the radiator 30 in a second direction opposite the first direction—i.e., pushing air through the radiator 30. This may be convenient to help eliminate dirt and debris from the radiator 30. The directional arrows 78, 80 illustrate the bidirectional airflow through the radiator 30. When air movement through the radiator is not desired in either direction, the fans 32, 34 may be operated at zero speed—i.e., the controller 18 may control the fans 32, 34 to be turned off. This may occur, for example, at a time when the fans 32, 34 do not need to be operated for cooling or as part of a fan-reversal strategy.

The control system 14 also includes a positioning system 82, which may be, for example, a global positioning system (GPS), which communicates and provides positioning information to the other controllers on the communications link 16. As explained in more detail below, the positioning system 82 is operable to determine a geographic location of the vehicle, which may be used by the controller 18 to implement a fan-reversal strategy for the fans 32, 34, or in some embodiments the fan 66, or in still other embodiments a combination of the fans 32, 34, and 66. The cooling system controller 18, the engine control module 20, the transmission control module 24, and the positioning system 82 represent one possible distributed control system; however, any number of other controller architectures that distribute the functionality of these controllers in various ways are possible to support embodiments of the present invention. For example, in automotive architectures the functionality of these controllers may be combined into a single controller such as a vehicle-system controller or a powertrain control module.

Figure 2:
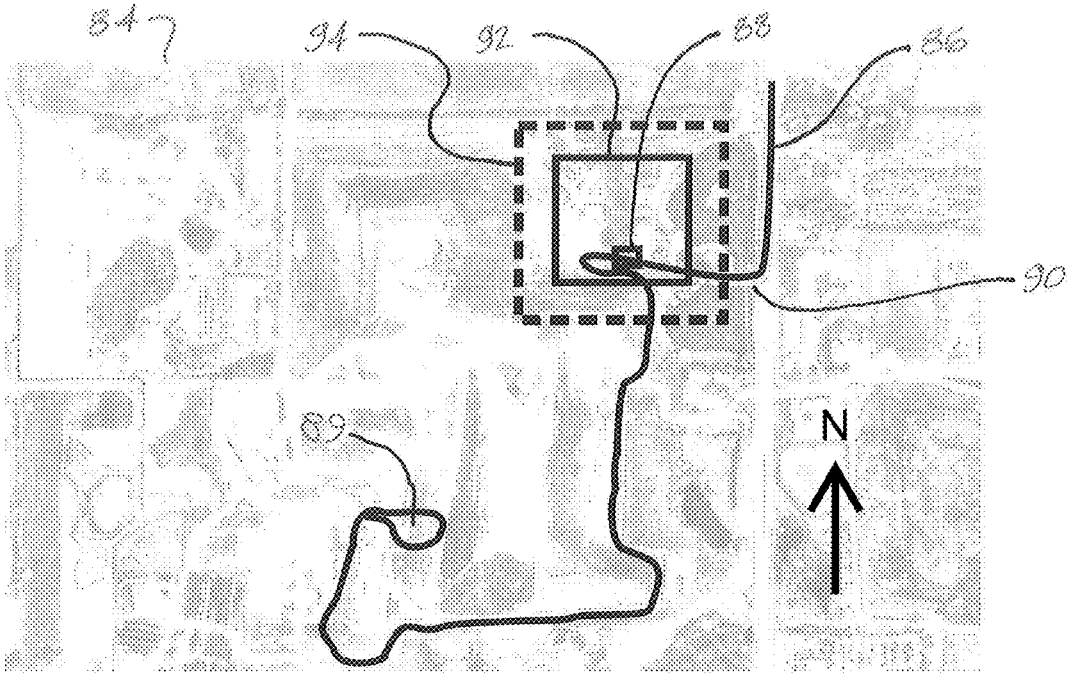
FIG. 2 shows map data for an application of a system and method in accordance with embodiments described herein.

FIGS. 2, 3A, 3B, and 3C show map data for an application of a system and method in accordance with embodiments described herein. The steps described in association with these figures may be, for example, performed by a processor associated with the controller 18, and may be performed in conjunction with other processors and memory storage associated with the controller 18, and in some embodiments in association with other processors associated with other controllers and other memory storage. Thus, unless otherwise noted, when a processor is described as performing certain steps, it may be a single processor or a number of processors working together. In some embodiments, the processor and the positioning system may be combined in a single unit, or a positioning system such as the GPS 82 may include a processor that communicates with a main processor such as a processor associated with the controller 18. FIG. 2 shows a projection of geographic map data 84. Superimposed onto the map data 84 is a defined vehicle route 86. The route 86 may be, for example, one during which it is desirable to perform a fan reversal in accordance with embodiments described herein.

In the embodiment shown in FIG. 2, the map data 84 shows a landfill where trash-hauling vehicles will frequently enter to dump their loads. As shown in FIG. 2, a weigh station 88 is located near an entrance 90 of the landfill. A normal practice may be for a trash hauler to enter the landfill and proceed immediately to the weigh station 88 to determine the amount of trash that will be dumped. A weigh station may be a convenient place to execute a fan-reversal strategy in accordance with embodiments described herein: the vehicle will be stopped for some time, and although the engine will be running, the need for engine cooling may be less than when the vehicle is traveling. As explained in more detail below, various embodiments described herein may include these or other criteria for determining a condition to implement a fan-reversal strategy. As shown in FIG. 2, the route 86 includes the weigh station 88, and then continues to an area 89 where the load will be dumped, after which time the vehicle will exit the landfill either by the same route 86 or by an alternative route.

Also shown in FIG. 2 are two predefined areas: there is a defined first geographic area 92 and a defined second geographic area 94 surrounding the first geographic area 92. In this embodiment, if the vehicle is in the first geographic area 92, it is also within the second geographic area 94. The defined geographic areas 92, 94 may be conveniently referred to as "geofences" because they define a geographic boundary similar to a fence and even define an area where specific actions may be taken—e.g., where certain control strategies may be implemented. The geofences 92, 94 may be, for example, programmed into the processor associated with the controller 18, or the GPS unit 82. The geographic areas 92, 94 may be chosen by a fleet manager or other planner based on any number of factors, including convenience, efficiency, availability, etc.

Figure 4:
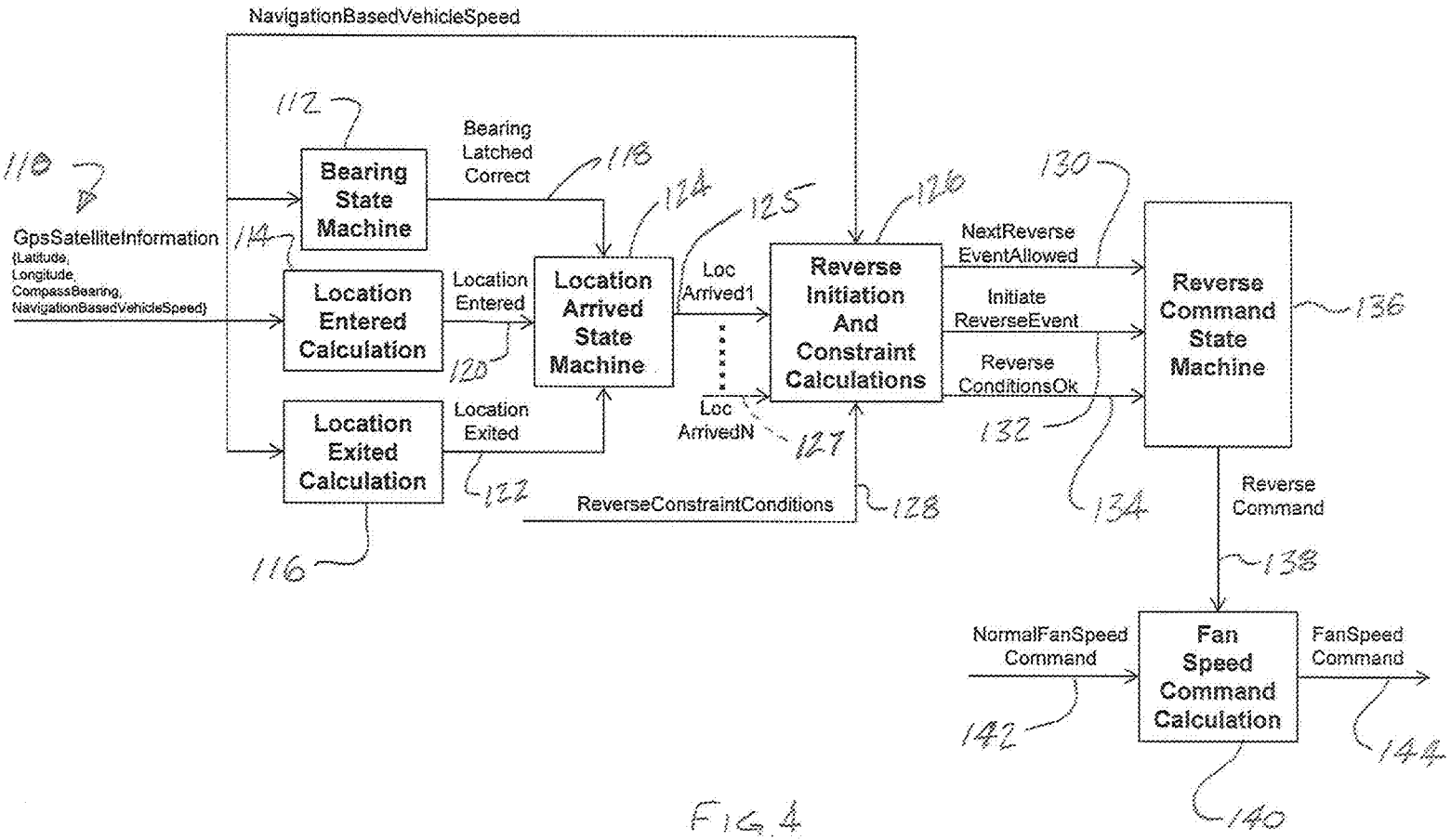
FIG. 4 shows a flowchart illustrating steps in accordance with a system and method of embodiments described herein.
Figure 5:
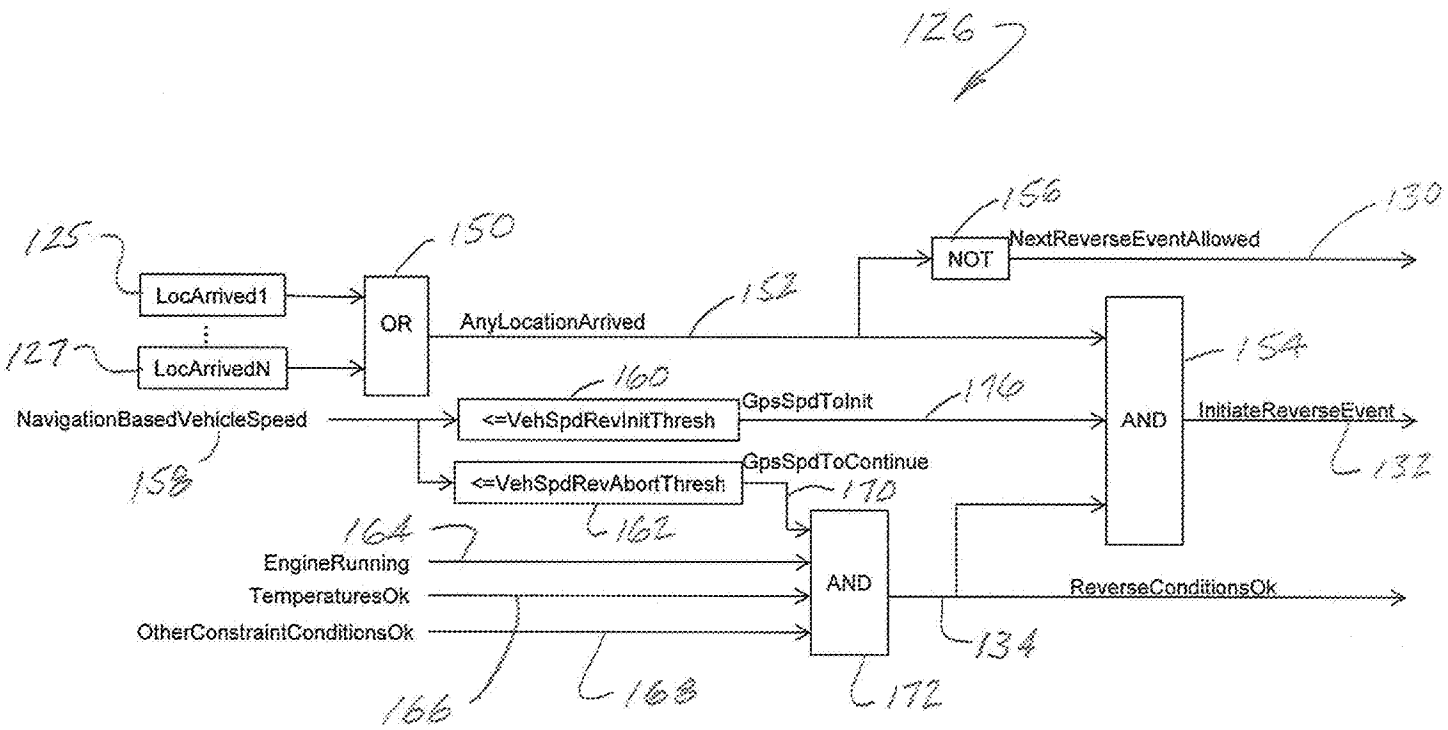
FIG. 5 shows further detail of the steps shown in the flowchart in FIG. 4.

As described in more detail in conjunction with FIGS. 4 and 5, embodiments described herein may rely on a processor, such as the processor associated with the controller 18 shown in FIG. 1 to operate the fans 32, 34 in accordance with a cooling strategy in certain situations and in accordance with a fan-reversal strategy in other situations. For example, when the vehicle is in a first vehicle operating state, such as when it is in motion, the processor may be configured to facilitate operation of the fans 32, 34 in the first rotational direction to pull air through the heat exchanger 30 as part of a cooling strategy for a heat-producing system or systems, such as the engine 22, the transmission 26, or both. Under certain other conditions, for example, when the vehicle is in a second vehicle operating state, the processor may be configured to facilitate operation of the fans 32, 34 in the second rotational direction to push air through the heat exchanger 30 as part of a cleaning strategy for the heat exchanger 30. The processor may facilitate operation of the fans 32, 34 in the first or second rotational directions by, for example, sending one or more signals to the fans 32, 34, either directly or through another processor or controller. Under other conditions, the processor may control the fan to be in an "off" state where its speed is zero and it neither contributes to the cooling nor acts as part of a cleaning strategy.

As explained in more detail in conjunction with FIGS. 4 and 5, systems and methods in accordance with embodiments described herein may be configured to operate fans, such as the fans 32, 34, in the second rotational direction only when a plurality of conditions are met or when the vehicle is in a second vehicle operating state. For example, the conditions and operating state may include the vehicle being within a first geographic area and the vehicle having been outside of a second geographic area since the last time a processor sent a signal to the fan to operate the fan in the second rotational direction. As applied to the illustration in FIG. 2, the processor associated with the controller 18 may be configured to operate the fans 32, 34 in the second rotational direction to clean the heat exchanger 30 by removing debris when the vehicle is within the first geofence 92 and it has been outside of the second geofence 94 since the last time the processor sent a signal to the fans 32, 34 to operate them in the second rotational direction. Therefore, once the fans 32, 34 are operated in the second rotational direction, the vehicle must not only leave the first geofence 92, but must also go outside of the second geofence 94 before the fan-reversal strategy will be allowed to be implemented again. This provides a position hysteresis that, among other things, keeps the fan-reversal strategy from being intermittently implemented with an undesirably high frequency. After the conditions are met and the fans 32, 34 are operated in the second rotational direction, the processor associated with the controller 18 may be configured stop the fans 32, 34—or again operate them in the first rotational direction. The stopping or change in direction may be based on desired criteria, such as, for example, a time limit, vehicle speed, engine speed, or a temperature indicative of engine temperature or other heat-producing system. With regard to vehicle speed, the criterion may include a high vehicle speed or an acceleration where vehicle speed is increasing. With engine speed, the criterion may include the engine speed being zero—i.e., the engine is not running.

Figure 3A:
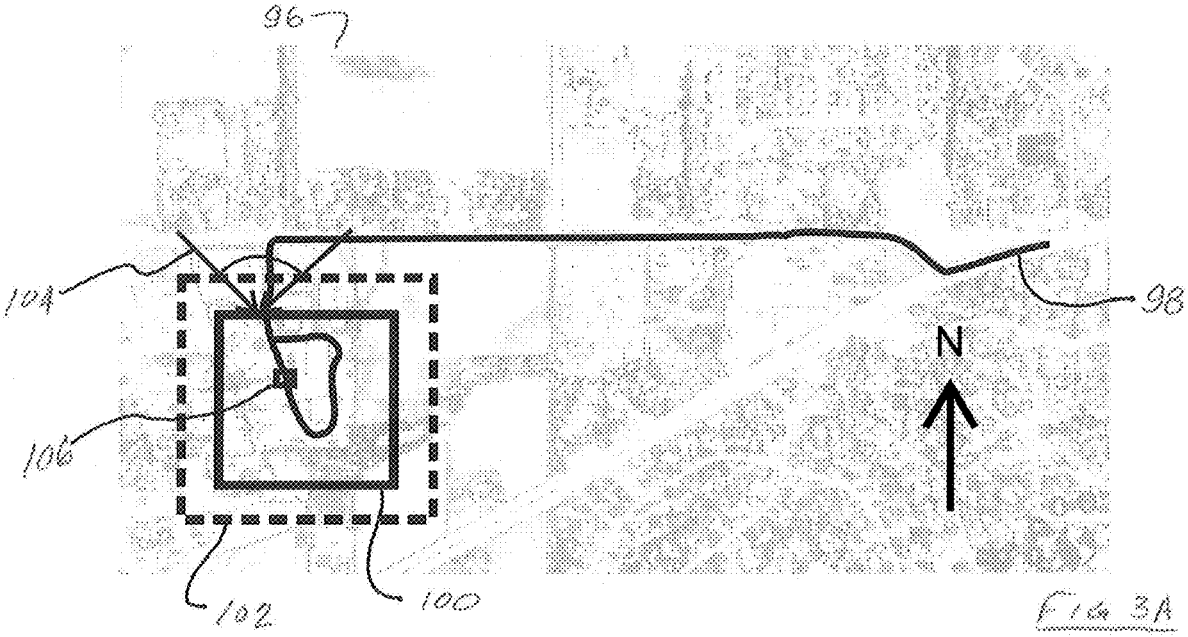
FIG. 3A shows map data for an application of a system and method in accordance with embodiments described herein.

Various embodiments of systems and methods described herein may have different sets of conditions under which the fan-reversal strategy will be implemented. For example, it may be important to limit implementation of the strategy to situations in which a vehicle enters a first geographic area from a particular geographic direction, or "bearing". One embodiment is illustrated in FIG. 3A, which shows map data 96 having a defined vehicle route 98 superimposed onto it. The map data 96 shows a vehicle depot, where, for example, trash haulers may be stored, maintained, etc. This location may be another convenient place where a fan-reversal strategy in accordance with embodiments described herein may be implemented. Shown in FIG. 3A, is a first geographic area 100 and a second geographic area 102, which surrounds the first geographic area 100. In some embodiments, both locations—i.e. the landfill shown in FIG. 2 and the depot shown in FIG. 3A—may be part of a fan-reversal strategy. In such a case, the geographic area 100 may be more conveniently referred to as a third geographic area, and the geographic area 102 may be conveniently referred to as a fourth geographic area. Other embodiments may include any number of other geographic areas where the fan-reversal strategy may be implemented.

Similar to the geographic areas 92, 94 shown in FIG. 2, the geographic areas, or geofences 100, 102, may be programmed into the GPS unit 82, which communicates with the controller 18 and its associated processor or processors, or it may be programmed into the processor of controller 18 itself. As applied to the situation illustrated in FIG. 3A, a set of conditions—e.g., defining a second vehicle operating state—may need to be met in order for the fan-reversal strategy to be implemented. For example, the vehicle may need to be within the first geofence 100 and it may also be required that it was outside of the second geofence 102 since the last time the processor sent a signal to the fans 32, 34 to operate them in the second rotational direction—i.e., the reverse direction. In the embodiment illustrated in FIG. 3A, at least one other condition is required for the fan-reversal strategy to be implemented: the vehicle must have entered the first geographic area 100 with a predetermined geographic bearing, which in this embodiment means within a particular bearing range.

Figure 3B:
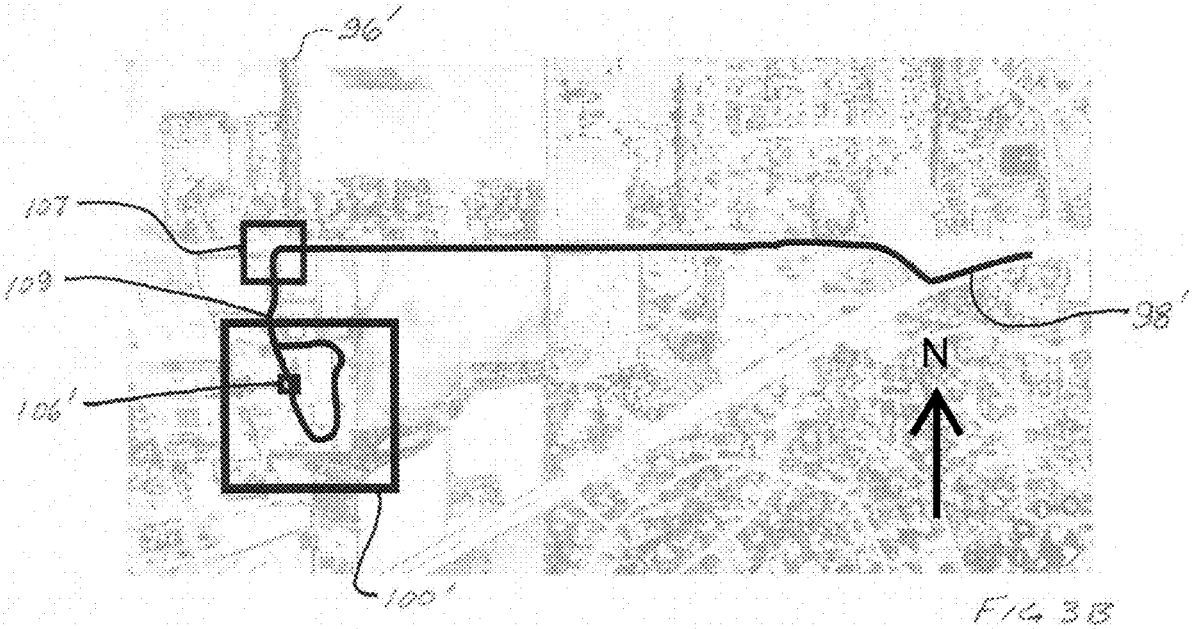
FIG. 3B shows map data for an application of a system and method in accordance with embodiments described herein.

As shown in FIG. 3A, a predetermined geographic bearing is defined to be a desired bearing range 104, although in other embodiments, the predetermined geographic bearing may be a single direction and not defined by a range. In FIG. 3A, the predetermined geographic bearing is superimposed on the map data 96. In this embodiment, the bearing range 104 is ±45° from South. Therefore, if the vehicle enters the first geofence 100 within the predetermined geographic bearing range 104, and the vehicle has been outside of the second geofence 102 since the last time the fan-reversal strategy was implemented, then the fan-reversal strategy may be implemented again. Within the first geofence 100 is a check station 106, which, like the weigh station 88, may be a convenient location to implement the fan-reversal strategy. FIG. 3B illustrates another way in which a geographic bearing of a vehicle may be identified or defined as part of a set of conditions or vehicle state related to the fan-reversal strategy.

Figure 3C:
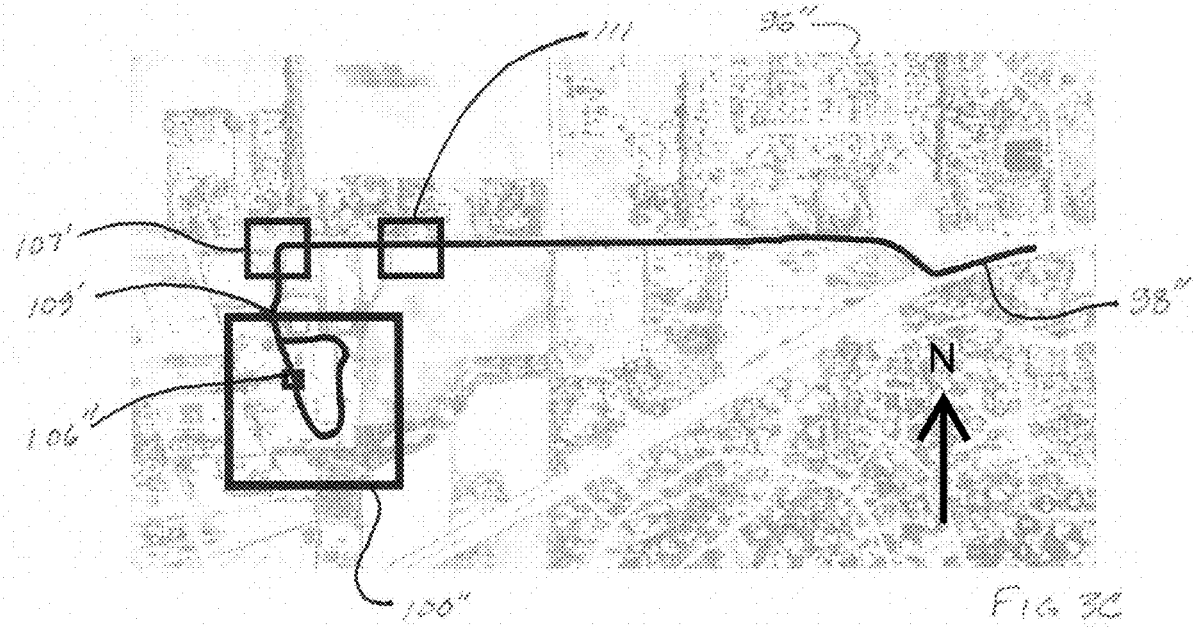
FIG. 3C shows map data for an application of a system and method in accordance with embodiments described herein.

FIG. 3B shows map data, a vehicle route, a first geofence, and a check station, which are respectively labeled 96', 98', 100', 106', with the prime (') symbol indicating elements that are the same or analogous to their counterparts shown in FIG. 3A—see also the description of FIG. 3C using the prime (') and double-prime (") symbols in the same way. In FIG. 3B, however, a second geofence 107 differs in a number of ways from the second geofence 102 shown in FIG. 3A. First, the second geofence 107 does not surround the first geofence 100: its size is unrelated to the first geofence 100, and it is positioned in front of an entrance 109 to the first geofence 100'. Another difference is that the second geofence 107 is not used as an "exit" geofence, but rather, it is used as an alternative method to determine the bearing of a vehicle as it enters the first geofence 100'. In the embodiment illustrated in FIG. 3A, the geographic bearing 104 was defined by a nominal direction and a range defining angular limits. In practice, it may be desirable to have a vehicle enter a geofence through a particular entrance, regardless of the angle of its approach. Configuring a second geofence, such as the geofence 107 shown in FIG. 3B, helps to accomplish this goal.

One of the conditions for implementing the fan-reversal strategy may be that a vehicle is required to enter the second geofence 107 before it enters the first geofence 100'. A second geofence may be defined so that when the vehicle exits the second geofence there is only one entrance into the first geofence. For example, in the embodiment shown in FIG. 3B, the geofence 107 is defined and positioned in close proximity to the first geofence 100; a vehicle leaving the second geofence 107 can only enter the first geofence 100' through the entrance 109. In other locations, a second geofence, such as the second geofence 107, may need to be closer or even abut or overlap the first geofence to ensure that the first geofence is entered only through the desired entrance. Some embodiments may also require that the vehicle enter the first geofence 100' within a predetermined period of time after leaving the second geofence 107. This temporal condition may help ensure that the vehicle does not exit the second geofence 107 and then drive to another entrance of the first geofence 100'. The predetermined period of time may be defined to be less than the amount of time necessary for the vehicle to enter another entrance after leaving the second geofence 107.

Embodiments described herein may use other ways to help ensure that the vehicle does not go through the second geofence 107' and then enter a first geofence 100" through an unplanned entrance. For example, FIG. 3C shows a third geofence 111 in addition to the first and second geofences 100", 107'. In this embodiment, the processor may be configured with another condition, specifically, that the vehicle must sequentially enter and exit the third geofence 111 and then the second geofence 107' prior to entering the first geofence 100". Only after this entry-exit-entry-exit sequence will the processor allow the fan-reversal strategy to be implemented. A temporal condition such as described above with regard to FIG. 2B may also be used with the third geofence 111.

As described above, FIGS. 2 and 3A define second geofences 94, 102 as "exit" geofences, which respectively surround first geofences 92, 100, and include a hysteresis for further implementations of the fan-reversal strategy. Although FIGS. 3B and 3C do not illustrate these kinds of exit geofences, they may nonetheless be used in conjunction with the sequential-entry conditions described in these embodiments. Thus, after the fan-reversal strategy is implemented in one of the embodiments shown in FIG. 3B or 3C, a vehicle may be required to move outside of an exit geofence that is adjacent to or surrounds the first geofence 100', 100", respectively, before a next implementation of the fan-reversal strategy is allowed. In other embodiments, an exit geofence may be defined to surround both a first geofence such as the geofence 100' and an adjacent geofence, such as the geofence 107. As applied to the embodiment in FIG. 3C, an exit geofence may surround the first geofence 100" and each of the adjacent geofences 107' and 111. In such embodiments, the strategy may require the vehicle to exit this surrounding, exit geofence before the fan reversal is again allowed.

Referring again to FIG. 3B, for subsequent implementations of the fan-reversal strategy, a processor may be programmed such that once the fan-reversal strategy has been implemented, a vehicle would once again need to enter the second geofence 107 before entering the first geofence 100'. In at least some embodiments, a vehicle may remain within the second geofence 107 for an indefinite period of time before entering the first geofence 100', which may be beneficial when a vehicle is waiting in a queue for entrance to an end location such as a landfill or depot. Using the configuration shown in FIG. 3B, a geographic bearing of a vehicle can be used as a condition for implementing the fan-reversal strategy without the need to define the bearing in terms of a specific angular direction or range of directions. Stated another way, the relative position between the first geographic area and the second geographic area may define the geographic bearing by which a vehicle enters the first geographic area.

In addition to the conditions described above—e.g., those related to the second geofences 94, 102, or those related to the second geofence 107, or second and third geofences 107', 111—embodiments described herein may require that other conditions be met, for example, before the vehicle is considered in the second vehicle state and the fan-reversal strategy is implemented. For example, with reference to the hysteresis described above with regard to the two different defined geographic areas—e.g., the geofences 92, 94 or 100, 102—an additional or alternative condition may include an amount of time since the last time the processor sent a signal to the fans 32, 34 to operate them in the second rotational direction—i.e., fan reversal. This would help keep the strategy from being repeatedly implemented if the vehicle exited the second geofence 94, 102 and then very quickly reentered the first geofence 92, 100. For example, the processor may be configured to determine a "no-reverse time" equal to an amount of time since the last time the processor sent a signal to the fans 32, 34 to operate in the second rotational direction; then the conditions may be set to include the no-reverse time being at least a predetermined amount of time. A similar temporal limitation may be used in other embodiments, for example, the embodiment shown in FIGS. 3B and 3C.

With regard to the embodiment illustrated in FIG. 3B, another condition may be that the vehicle must remain in the second geofence 107 for some period of time—e.g., several seconds—for purposes of debouncing such that its position can be verified. Whether to use this vehicle "dwell" time, or how long it should be, may depend on a number of factors, including the type of positioning system used and the speed and accuracy with which the vehicle position can be verified. Other conditions may also be required before the fan-reversal strategy is implemented, for example, it may be desirable to have the speed of the vehicle less than a predetermined speed so that the fan-reversal does not work against "ram air" entering the heat exchanger 30 because of the forward motion of the vehicle.

It may also be desirable to limit implementation of the fan-reversal strategy to situations where the engine is running—i.e., the engine speed is greater than zero. Some reasons for requiring this condition may include limiting audible noise when the engine is not making noise, preventing high power consumption when the engine is not creating power so as to not deplete energy storage devices, or preventing airflow when the engine is not running such as during maintenance procedures. Temperature may also be a consideration, so that if a temperature of the engine 22 is too high, the strategy may not be implemented. In practice, a temperature of the engine may be a temperature that is indicative of engine temperature, such as a temperature of the coolant flowing through the heat exchanger 30, a temperature of the air flowing through the engine air intake line 68, or an estimate of a temperature based on other measurements. Therefore, a condition of implementing the strategy may be that a temperature indicative of an engine temperature, or another vehicle component such as a transmission temperature, is less than a predetermined temperature. In some embodiments, the fan-reversal strategy may be implemented if the vehicle is positioned within the first geographic area and the other conditions are met unless the vehicle was started while already in the first geographic area. That is, if the vehicle is inside the first geographic area at key-on, the fan-reversal strategy may not be implemented even if the other conditions are met. In this situation, the control strategy may require that the vehicle leave the first geographic area and later reenter it before the fan reversal is allowed again.

FIG. 4 shows a schematic diagram 108 illustrating steps in accordance with the system and method of at least some of the embodiments described herein. Referring to the physical elements illustrated and described in conjunction with FIG. 1, the schematic diagram 108 begins with inputs 110 from an electronic positioning system, such as the GPS unit 82. As shown in FIG. 4, the inputs may include one or more of the following parameters for a vehicle: latitude, longitude, measured or calculated compass bearing, or measured or calculated navigation-based vehicle speed. The inputs from the GPS unit 82 are fed into three separate areas, a bearing state machine 112, an algorithm performing a location-entered calculation 114, and an algorithm performing a location-exited calculation 116.

The bearing state machine 112 determines if the calculated bearing is within the user setpoint bearing range—see, e.g., FIG. 3A showing the geographic bearing range 104—for entry into the geofence 100. The user setpoint bearing range may be selected to be at least as large as the largest and smallest measured or calculated bearing expected at the desired entry into the geofence 100. It may include a consideration of an adjustment for errors of the bearing measurement or calculation, curvature of the road, and variations in vehicle handling by the drivers of the vehicles. This allows the automated reverse of the fans to occur only when the geofence 100 is entered from a single direction or range of directions and prevents the automated reverse from occurring when entry occurs from all other directions. As one example, the fan reverse may be desired when the vehicle exits a landfill but prevented when the vehicle enters the landfill.

In the embodiment shown in FIG. 4, the bearing state machine 112 first requires all of the related GPS inputs 110 to be recently received and valid. It then requires the vehicle speed reported by the GPS device 82 to be high enough that the bearing calculation also being received will be reliable. GPS devices may calculate the bearing from satellite information based on changes in calculated position for which no bearing can be determined at zero speed. In such cases the calculated bearing becomes less reliable as the vehicle speed is reduced toward zero where no bearing can be determined. GPS devices may also incorporate a compass which then allows a bearing to be determined by the compass measurement and may provide a reliable bearing at all vehicle speeds including zero speed. Passing through the states in the bearing state machine 112 provides a "debounce and hold" mechanism to confirm and then hold the confirmation as to whether the bearing calculation matches the user setpoint bearing range for the particular geofence. This may be particularly beneficial where vehicle speed changes and causes the bearing calculation to become intermittently unreliable.

This debouncing addresses the situation when, for example, a vehicle is entering the geofence at slow stop-and-go speeds where the validity and reliability of the bearing calculation is intermittent, by requiring multiple measurement samples to confirm that the bearing calculation is reliable. The hold functionality addresses the situation when the vehicle moves into the geofence at very slow speeds below which the bearing can be reliably calculated. It does this by holding the last reliable bearing calculation confirmed by the debounce strategy and using it to determine whether the direction of vehicle travel is within the user setpoint bearing range. An example of both would be a refuse truck in a long line waiting to pass over a weigh scale before it exits a landfill area, such as the landfill area shown in FIG. 2.

The output 118 of the state machine 112—labeled in FIG. 4 as "Bearing Latched Correct" presents an indication as to whether the last known valid bearing calculation matches the user setpoint bearing required to allow the automated reversal. In some applications it may be desirable to allow the automated reverse to occur when a geofence, such as geofence 100, is entered from any direction for which case the output of 118 of the bearing state machine 112 would always output the "Bearing Latched Correct" as true—see for example the embodiment shown in FIG. 2.

The next steps in the embodiment illustrated in the schematic 108 are the location-entered calculation 114 and the location-exited calculation 116. Location-entered and location-exited geofences—see, e.g., the geofences 92, 94 and the geofences 100, 102, respectively—are set up with a hysteresis between them as described above. Each pair of geofences is defined where an automated reverse may be allowed to initiate within the entered boundary, but not allowed to initiate outside of the exited boundary. One way to define the distance between a pair of location-entered and location-exited geofences is to make the distance at least as large as a measurement error associated with a positioning system, such as the GPS 82. Stated another way, the hysteresis is defined so that it is at least larger than the expected GPS measurement error. Additionally, this hysteresis band may be increased to larger values than the expected GPS measurement noise error to obtain the desired automated reversal decision behavior based on other factors and considerations that may include terrain, curvature of the roadways, alternative roadways, and variation of various operator driving patterns. This hysteresis band may increase the stability of the state machines that rely on these calculations for the automated reverse decision that will occur later in the control logic.

The width and height of the location-entered geofence may be selected by the user to form an approximation of a rectangle. In at least some embodiments, the coordinate center of the geofence is defined and then a linear distance from the center to the North-South boundaries and a second linear distance from the center to the East-West boundaries may be selected. These linear distances can then be used to directly translate the linear distances to angular spherical coordinate distances in degrees so that the geofence boundaries are defined in the same units of measure as may be reported by positioning systems such as the GPS 82. Because of the curvature of the earth, the result may not be an exact rectangle, but it will likely provide a sufficiently-defined boundary for the purposes of automated reversal determination.

An output of the location-entered calculation 114 is a location-entered signal 120, and an output of the location-exited calculation 116 is a location-exited signal 122. The signals 120, 122 are provided to a location-arrived state machine 124, which also receives the bearing latched correct signal 118. The state machine 124 determines a valid arrival into a user-defined geofence having a direction of approach that is within the user defined bearing range, which may include combining the previous location entered, location exited and bearing latched correct calculations, as well as re-initialization of the arrival determination when the GPS satellite information becomes unavailable. The state machine 124 may incorporate debouncing of its input signals in an attempt to reject momentary measurement noise of the GPS satellite information. Sources of measurement noise may include normal measurement and calculation errors as the GPS device translates its measured signals into the parameters used by the prior calculations; however, it may also have stepwise disturbances when the GPS device adds or removes a satellite from use in its calculations. It is also known that GPS devices tend to have greater measurement noise shortly after powering on as it performs its initial satellite acquisition, so this may be managed as well.

The state machine 124 also determines when a valid arrival indication is to be canceled. One example is when the location-exited signal 122 indicates that the vehicle position has moved outside of the location exited geofence—see, e.g., the geofences 94, 102—thereby providing vehicle-positional hysteresis in the location arrived calculation. This hysteresis provides stability to the location-arrived calculation when the vehicle is operating near a boundary of the location-entered geofence—see, e.g., the geofences 92, 100—and measurement noise may otherwise cause the location-entered calculation to change back and forth between indicating entered and not entered in rapid succession.

The state machine 124 may also consider the condition as to whether the vehicle is within the geofence when it is started. This condition may be an optional, user-selectable provision to either allow or disallow an arrival determination for the case that the vehicle is turned on within the user defined geofence. It may be desirable in some applications for the fan reversal to occur each day in the parking lot where the vehicle is normally parked immediately after startup, while other applications may wish to avoid this. For example, in some embodiments, the conditions may include the vehicle being keyed-off in the first geographic area—for example the area 100 shown in FIG. 3A—and keyed-on in the first geographic area. Factors in this decision may include audible noise concerns and debris removal from the reversal event. The state machine 124 may also enforce the exiting of the user-defined location-exited geofence area for a period of time after a prior calculation of an arrival from either a correct or incorrect bearing before allowing an additional arrival confirmation. This is an additional debounce mechanism that may prevent multiple reversal events from occurring as a vehicle moves through the user defined geofence area or into and out of the location-entered and location-exited geofence areas in rapid succession, which may occur because of the curvature of the roadway or an operator performing a back-and-forth operation of the vehicle, among other reasons.

The output of the state machine 124 is a location-arrived signal, shown in FIG. 4 as "Loc Arrived 1" 125. As described above, embodiments may include a processor or positioning system programmed with a predetermined location, such as a landfill or depot. Some embodiments may be programmed with a number of locations such that a fan-reversal strategy is implemented in more than one place. This is illustrated in the output of the state machine 124 shown in FIG. 4. The first location-arrived signal 125 is based on the state machine 112 and the calculations 114, 116, and their respective outputs 118, 120, 122, each of which acts as an input to the state machine 124. Other location-arrived signals for different locations can be determined in the same way—i.e., for different locations, another state machine 112' and calculations 114', 116' provide outputs, which act as inputs to a state machine 124' and another location-arrived signal is generated. This process can be repeated for any number (N) of locations as indicated by the signal "Loc Arrived N" 127.

The output of this state machine 124 is provided to an algorithm 126 where reverse-initiation-and-constraint calculations are performed. Also provided to the algorithm 126 is a set of reverse constraint conditions 128, which are further described in conjunction with FIG. 5. The outputs from the algorithm 126 include a signal 130 related to when the next reverse event is allowed, a signal 132 related to if a reverse event may be initiated, and a signal 134 related to if an in-process reverse event may continue. The steps of the reverse-initiation-and-constraint calculations 126 are described in more detail in conjunction with FIG. 5. The output signals 130, 132, 134 are provided as inputs to a reverse-command state machine 136, which may output a reverse command 138 to an algorithm 140 configured to calculate a fan-speed command 144.

The reverse-command state machine 136 may indicate a command to reverse the fan or fans when the input to initiate a reverse event 132 is indicated. It may continue to indicate a command to reverse, or may terminate reversal of, the fan or fans based on additional criteria or conditions as appropriate to the application. For example, the reverse-command state machine 136 may terminate the fan reversal at a predetermined period of time. Based on the desired results, the reverse-command state machine 136 may also terminate the reverse event when position information indicates the vehicle has moved outside of the location-exited geofence, or in other embodiments may allow the reverse event to continue for a period of time after the position information indicates the vehicle has moved outside of the location exited geofence.

The reverse-command state machine 136 may also terminate a reverse event when the "Reverse ConditionsOk" input 134 indicates that the reverse conditions are no longer met—e.g., as determined by the reverse initiation and constraint calculations 126. Additionally, the reverse command state machine 136 may inhibit the initiation of a reverse event indicated by the initiate reverse event input 132 when the next reverse event allowed input 130 indicates that a reverse event should not be allowed, which is described in more detail in conjunction with FIG. 5. This inhibit function may prevent a next reversal event from occurring until the position of the vehicle has exited the location-exited geofence; this may provide a number of advantages. For example, it may be desirable to prevent more than one reversal event from being commanded while a contiguous location-arrived determination is indicated by the location-arrived output 125 of the location arrived state machine 124.

The fan-speed-command calculation 140 may calculate the fan-speed command 144 based at least in part on the condition that an automated-fan-reversal event is indicated or not indicated. It may also include other inputs, such as a normal-fan-speed command 142, which, for example, may be part of a cooling strategy rather than a reverse-fan strategy. When a reverse command 138 is not indicated, the fan-speed-command calculation 140 may set its output to an input such as the normal fan speed command 142; however, when a reverse command 138 is indicated, it may override the normal-fan-speed command 142. When a reverse command 138 is indicated, the fan speed command calculation 140 may determine an appropriate reverse-direction fan speed. The fan speed may be determined by one or more factors based on the particular application. For example, a maximum fan speed may be chosen to provide the maximum airflow to maximize the opportunity for debris removal from the heat exchanger; alternatively, a fan speed less than the maximum may be chosen to provide a reversal event with a reduced airflow, a lower audible noise level, or a lower power consumption. In some embodiments, the fan speed for the reverse command may always be set at a predetermined level—e.g., maximum speed, three-quarters speed, etc. Finally, a fan speed command 144 is output from the algorithm 140.

FIG. 5 shows a flowchart 126 having steps previously identified in FIG. 4. The flowchart 126 identifies any number of arrival locations 125, 127, which may be a landfill or depot as described in conjunction with FIGS. 2, 3A, 3B and 3C, or may include or alternatively be defined as other locations convenient for a fan-reversal strategy to be implemented. A comparator 150 determines if a vehicle has arrived at any of the predefined locations, and then outputs a signal 152 to another comparator 154 described in more detail below. The signal 152 also is provided to another algorithm 156 where it is determined whether a next reverse event will be allowed and in this embodiment indicates that the vehicle has left all of the predefined reversal locations; this corresponds to the signal 130 shown in FIG. 4.

The flowchart 126 also illustrates the step of using a navigation-based vehicle speed 158 as an input to algorithms 160, 162, which respectively determine whether the vehicle speed is below a first threshold to initiate the fan reversal and whether the vehicle speed is below a second threshold. The second threshold may be the same or higher than the first threshold and may be used to continue or allow to continue a fan reversal that is in process. These two thresholds may be selected to provide a hysteresis with respect to determining fan-reversal indicators in the presence of vehicle motion, and further may be selected in a manner that is efficient in cleaning debris from a heat exchanger when the vehicle is moving. They may be particularly important in applications where the airflow through the heat exchanger is significantly impacted by motion of the vehicle such as front-mounted cooling systems directly subjected to ram-air. In some embodiments, algorithms 160, 162 may be eliminated, for instance, in applications where vehicle speed does not significantly impact the airflow through the heat exchanger.

Also shown in the flowchart 126 are additional reverse constraint conditions, which include a signal 164 indicating whether the engine 22 is running, a signal 166 indicating whether temperatures affected by the cooling system are within acceptable limits, and a signal 168 indicating whether other constraint conditions are within predetermined limits. Also, as described above, a temperature of a heat-producing system, such as the engine 22 or transmission 26 may be considered when determining whether to implement the fan-reversal strategy. The calculations that consider the temperature and produce the signal 166 may include a calculation that indicates that any of the temperatures within the system that may be affected by a fan-reversal event are not expected to exceed their design limits should a reverse event be allowed to occur—for initiating a reverse event—or to continue—for not aborting an ongoing reverse event. As described above, embodiments of a fan-reversal strategy may consider a number of factors, such as limiting audible noise when the engine is not running, preventing high power-consumption when the engine is not generating power so as to not deplete energy-storage devices, or preventing airflow when the engine is not running such as during maintenance procedures. These factors may all be included in the calculations that determine the input signal 168.

The other constraint conditions considered to generate the output signal 168 may include any number of other conditions necessary to implement the fan-reversal strategy in accordance with embodiments described herein. For example, these other conditions may include indicators that the audible noise of a reverse event may be unacceptable, indicators such as time of day or special modes of vehicle operation, or indicators that the electrical power consumption of a reverse event may be unacceptable. Other constraints may also be imposed to prevent a reversal where it may be undesirable to implement the fan-reversal strategy. For example, if the vehicle is in a "limp-home" mode of operation where it has sustained some electrical or mechanical failure and it is operating at a reduced level, if the vehicle is a military vehicle in a "battle mode", which could be manually selected by an operator, or if the vehicle is operating with very high electrical loads, it may be undesirable to operate the fan-reversal strategy.

The signals 164, 166, 168 as a group are illustrated in the schematic diagram 108 as the reverse constraint conditions 128 and are processed by the algorithm 126. As shown in the flowchart 126, the output signals 164, 166, 168 are combined with an output signal 170 related to the calculation at step 162, and are input into a comparator 172. The output from the comparator 172 is the signal 134—see also FIG. 4. The signal 134 indicates that the reverse conditions are acceptable—i.e. the constraint conditions are met, and the fan-reversal strategy is allowed to be initiated and to continue. The output signal 134 is also input into the comparator 154 where it is combined with the output signal 152 from the calculation at step 150 and output signal 176 from the calculation at step 160. The output from the comparator 154 is the signal 132—see also FIG. 4. This signal provides the command to initiate a reverse event. The output signals 130, 132, 134 from the flowchart 126 lead directly into the reverse-command state machine 136 shown in FIG. 4.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A control system for a vehicle having a heat exchanger and a fan operable to move air through the heat exchanger, the control system comprising:

a positioning system operable to determine a geographic location of the vehicle; and a processor in communication with the positioning system, at least one of the processor or the positioning system being programmed with a defined first geographic area and with at least one other defined geographic area, the processor being configured to send a signal to the fan to operate the fan in a first rotational direction to move air through the heat exchanger in a first direction, and to send a signal to the fan to operate the fan in a second rotational direction opposite the first rotational direction to move air through the heat exchanger in a second direction opposite the first direction when a plurality of conditions are met, the conditions including the vehicle having entered at least one of the at least one other defined geographic area and thereafter having entered the first geographic area.

2. The control system of claim 1, wherein the conditions further include the vehicle having entered the at least one other geographic area since a last time the processor sent a signal to the fan to operate the fan in the second rotational direction.

3. The control system of claim 1, wherein the at least one other defined geographic area includes a second geographic area, and the conditions further include the vehicle having exited the second geographic area prior to having entered the first geographic area and the vehicle having entered the first geographic area within a predetermined amount of time since the vehicle exited the second geographic area.

4. The control system of claim 1, wherein the conditions further include the vehicle being keyed-off in the first geographic area and keyed-on in the first geographic area.

5. The control system of claim 1, wherein the conditions further include the vehicle having entered the first geographic area with a predetermined geographic bearing.

6. The control system of claim 5, wherein the at least one other defined geographic area includes a second geographic area, and the predetermined geographic bearing is defined by a relative position between the first geographic area and the second geographic area.

7. The control system of claim 1, the vehicle further having at least one heat-producing system, including an engine, and wherein the conditions further include at least one of a temperature indicative of a temperature of at least one of the at least one heat-producing system being less than a predetermined temperature, the engine running, or a speed of the vehicle being less than a predetermined speed.

8. The control system of claim 1, wherein the at least one other defined geographic area includes a second geographic area and a third geographic area, and the conditions further include the vehicle having entered the third geographic area prior to the vehicle having entered the second geographic area and thereafter having entered the first geographic area.

9. The control system of claim 1, wherein the at least one other defined geographic area includes a second geographic area, and the conditions further include the vehicle having been outside the second geographic area for a predetermined amount of time.

10. A control system for a vehicle having a heat exchanger and a fan operable to move air through the heat exchanger, the control system comprising:

a positioning system operable to determine a geographic location of the vehicle; and a processor in communication with the positioning system, at least one of the processor or the positioning system being programmed with a first geographic area and a second geographic area, the processor being configured to:

send a signal to the fan to operate the fan in a first rotational direction to move air through the heat exchanger in a first direction based on a first vehicle operating state, and send a signal to the fan to operate the fan in a second rotational direction opposite the first rotational direction to move air through the heat exchanger in a second direction opposite the first direction based on a second vehicle operating state that includes the vehicle having entered the second geographic area and thereafter having entered the first geographic area.

11. The control system of claim 10, wherein the second vehicle operating state further includes the vehicle being keyed-off in the first geographic area and keyed-on in the first geographic area.

12. The control system of claim 10, the vehicle further having at least one heat-producing system, and wherein the second vehicle operating state further includes a temperature indicative of a temperature of at least one of the at least one heat-producing system being less than a predetermined temperature, or a speed of the vehicle being less than a predetermined speed.

13. The control system of claim 10, wherein the second vehicle operating state further includes the vehicle having entered the first geographic area with a predetermined geographic bearing.

14. The control system of claim 13, wherein the predetermined geographic bearing is defined by a relative position between the first geographic area and the second geographic area.

15. The control system of claim 10, wherein the second vehicle operating state further includes a predetermined amount of time having elapsed since a last time the processor sent a signal to the fan to operate the fan in the second rotational direction.

16. The control system of claim 10, wherein the second vehicle operating state further includes the vehicle having exited the second geographic area prior to having entered the first geographic area and the vehicle having entered the first geographic area within a predetermined amount of time since the vehicle exited the second geographic area.

17. A control system for a vehicle having a heat exchanger and a fan operable to move air through the heat exchanger, the control system comprising:

a positioning system operable to determine a geographic location of the vehicle; and a processor in communication with the positioning system, at least one of the processor or the positioning system being programmed with a defined first geographic area and a defined second geographic area, the processor being configured to facilitate operation of the fan in a first rotational direction to move air through the heat exchanger in a first direction, and to facilitate operation of the fan in a second rotational direction opposite the first rotational direction to move air through the heat exchanger in a second direction opposite the first direction when predetermined conditions are met, the predetermined conditions including having entered the second geographic area and thereafter having entered the first geographic area.

18. The control system of claim 17, the vehicle further having at least one heat-producing system, including an engine, and wherein the predetermined conditions further include at least one of a temperature indicative of a temperature of at least one of the at least one heat-producing system being less than a predetermined temperature, the engine running, or a speed of the vehicle being less than a predetermined speed.

19. The control system of claim 17, wherein the predetermined conditions further include the vehicle being keyed-off in the first geographic area and keyed-on in the first geographic area.

20. The control system of claim 17, wherein the predetermined conditions further include the vehicle having entered the first geographic area with a predetermined geographic bearing.

* * * * *